United States Patent [19]

Lightstone et al.

[11] 3,979,981

[45] Sept. 14, 1976

[54] CRYOGENIC SHEARING OF METAL

[75] Inventors: John Bernard Lightstone, White Plains, N.Y.; Richard Benedict Mazzarella, Indianapolis, Ind.

[73] Assignee: Union Carbide Corporation, New York, N.Y.

[22] Filed: May 20, 1974

[21] Appl. No.: 471,477

[52] U.S. Cl. ..... 83/15; 83/170

[51] Int. Cl.[2] ..... B26D 7/08

[58] Field of Search ..... 83/15, 16, 170, 171

[56] References Cited

UNITED STATES PATENTS

| | | | |
|---|---|---|---|
| 2,551,094 | 5/1951 | Bryce et al. | 83/15 X |
| 2,586,532 | 2/1952 | Granfield | 83/15 X |
| 2,956,717 | 10/1960 | Scharf | 83/170 X |
| 3,151,991 | 10/1964 | Evans et al. | 83/15 X |
| 3,332,307 | 7/1967 | Shanok | 82/47 |
| 3,646,841 | 3/1972 | Villalobos | 83/170 X |

*Primary Examiner*—J. M. Meister

*Attorney, Agent, or Firm*—Saul R. Bresch

[57] ABSTRACT

A process for shearing metal which substantially eliminates the effects of plastic deformation in the sheared metal edge. The process comprises (1) cooling the work metal to a cryogenic temperature, and (2) shearing the cooled metal to form a sheared workpiece having edges relatively free of plastic deformation and dimensional distortion. The shearing operations contemplated by the invention include punching, blanking, piercing and slitting.

2 Claims, No Drawings

CRYOGENIC SHEARING OF METAL

This invention relates, in general, to shearing of metal, and more particularly, to metal shearing conducted at cryogenic temperatures.

Blanking and piercing are metal shearing operations in which shapes are cut from flat and preformed stock with a punch and die. Blanking and piercing are similar operations except that in piercing the punched-out (blanked) slug is scrap and the surrounding metal is the workpiece whereas in blanking, the punched-out portion is the workpiece. Ordinarily, a blank serves as a starting workpiece for a formed part; less often, it is the desired end product.

The disadvantages of blanking and piercing relate primarily to the quality and accuracy of the metal cutting operation. The sheared edges of a blank produced in a conventional die are not smooth and vertical for the entire thickness of the part, but rather, are characterized by rollover and burrs. Rollover develops on the lower edges of the blank due to the plastic deformation of the work metal as it is forced into the die by the punch. As the punch completes its stroke, the upper portion of the blank edge is fractured resulting in a tensile burr along the top edge of the blank. Pierced holes are similarly affected. The side wall of a pierced hole is generally smooth and straight for only a portion of the thickness of the workpiece near the punch end of the hole; the remaining portion of the wall is broken out in an irregular cone producing what is commonly referred to as fracture or breakout. The operation of hole piercing typically begins as a cut that produces a burnished surface on the hole wall and some rollover. The punch completes its stroke by fracturing and tearing away the metal that was not cut during the initial part of the piercing operation. As a general rule, the extent of rollover in a blank or pierced hole increases with the thickness of the work metal and decreases with the hardness of said metal; relatively thick and soft work metals being consequently particularly susceptible to unwanted plastic deformation during shearing.

Conventional methods of improving the quality of a hole wall or the profile of a blank edge include shaving the side wall of the pierced hole, reaming, high speed punching which minimizes plastic deformation in the metal by inducing relatively high rates of strain, and fine edge blanking wherein the clearance between the punch and die is maintained below a critical dimension depending upon the nature of the work metal. These techniques, however, materially increase the expense of the overall shearing operation because of the increased time, effort and equipment cost required. High speed punching, for example, severely reduces the operating life of the punch and die assembly due to the increased wear at the higher speeds. Thus, the increased tool wear in combination with the relatively large power requirement for the high speed machinery makes the overall process economically prohibitive for most applications.

Slitting and shearing of flat sheet and bar sections are other shearing operations wherein the sheared metal is often subject to distortion. In general, slitting involves cutting a flat sheet of metal with a circular blade into strips of specified length, whereas bars and bar sections are generally sheared between upper and lower blades. When flat sheet metal is cut into relatively narrow strips, such strips are frequently twisted and bowed during the slitting operation to the extent that a subsequent straightening operation is frequently required depending upon the intended application. In shearing of bar sections, the workpiece is generally distorted as the upper blade is forced down and fractures the metal resulting in burrs along the edges. Consequently, there is a need for a shearing process capable of slitting a material such as steel to produce relatively straight and undeformed narrow strips and for shearing steel bars into sections having a minimum of distortion.

When metal is sheared, the material adjacent to the sheared edge is usually in a work-hardened condition due to the plastic deformation that takes place during the formation of a sheared edge. This plastic deformation reduces the ductility of the material near sheared edges, which often results in the appearance of cracks during subsequent forming operations. In the blanking and piercing of magnetically soft materials, the work hardening gives rise to undesirable magnetic properties. Consequently, there is a need for a shearing process that substantially reduces the work-hardened region near the sheared edge.

OBJECTS

Accordingly, it is an object of the present invention to provide a process for shearing metal which minimizes the formation of rollover and burrs in the workpiece.

It is a further object of the invention to provide a process for shearing sheet metal into relatively narrow strips devoid of twisting and bowing.

It is a further object of the invention to provide a process for shearing metal which minimizes the extent of the work-hardened region in the sheared metal.

SUMMARY OF THE INVENTION

These and other objects which will become apparent from the detailed disclosure and claims to follow are achieved by the present invention one aspect of which comprises:

a process for shearing metal which substantially eliminates the effects of plastic deformation in the sheared metal edge comprising the steps of:

1. cooling the metal to be sheared to a cryogenic temperature, and 2. shearing said metal while at said cryogenic temperature to form a sheared workpiece having edges relatively free of plastic deformation and dimensional distortion.

The term "shearing" is used throughout the specification and claims in its strict technical sense of pertaining to metal forming operations wherein the force applied to the workpiece is a vector parallel to the area to be deformed. Accordingly, the shearing operations contemplated by the present invention are restricted to punching, blanking, piercing, slitting and the shearing of flat sheet or bar sections between upper and lower blades.

The term "cryogenic temperature" as used herein is intended to encompass the range of temperature corresponding to conventional cryogenic fluids. Thus, cooling of the workpiece to a "cryogenic temperature" refers to temperatures below −70°C, with liquid nitrogen being the preferred cryogen. Other cryogenic fluids which may be used include liquid $CO_2$ and liquid $H_2$.

The term "metal" as used herein is restricted to metals and alloys having a body centered cubic crystallographic structure, such as, for example, iron, molybdenum and tungsten.

The invention is based on the discovery that plastic deformation and work hardening in a sheared work metal can be substantially reduced or eliminated in body centered cubic metals if the workpiece is maintained at a sufficiently low temperature during the shearing operation. The elimination of rollover and burrs in sheared metal such as, for example, a blanked slug, is believed to be due to the fact that adiabatic heating of the workpiece can be readily achieved at cryogenic temperatures, thereby localizing the energy of deformation to a region of relatively high temperature corresponding to the planar surface to be sheared. Thus, the primary effect of adiabatic heating is to localize deformation by preventing heat diffusion from the localized region of shear into surrounding metal thereby insuring that said surrounding metal does not become ductile and plastically deformed. Consequently, shearing operations in accordance with the invention may be carried out with minimal distortion such as rollover and burrs in blanked articles or with minimal twisting and bowing in slitted or sheared strips of metal.

The elimination of a plastically deformed region near the sheared edge is particularly important in a fabrication process for magnetically soft sheet metal used in transformer laminations. Work-hardening near sheared edges in these materials gives rise to undesirable magnetic losses. Therefore, it is particularly advantageous to shear such mangetically soft materials in accordance with the present invention so as to avoid the annealing steps which are ordinarily required subsequent to a room temperature shearing operation.

DETAILED DESCRIPTION OF INVENTION

In a preferred embodiment of the process of the present invention the metal workpiece is cooled to a cryogenic temperature with a cryogenic fluid such as liquid nitrogen and thereafter sheared in a blanking or punching operation. The methods that can be used to cool the work metal to cryogenic temperatures are well known in the art and will vary depending on the particular application. For example, in typical coil-slitting lines or in lines that shear blanks from steel strip, the starting material is in the form of a coil. After uncoiling the sheet in an uncoiler, the sheet may be passed through a tank filled with a suitable cryogenic fluid such as liquid nitrogen. The velocity of the sheet and the size of the cryogenic tank are designed so that the residence time of the sheet in the cryogen is sufficient to insure cooling of the sheet to the desired cryogenic temperature. Thus, the required exposure time of the sheet to the cryogenic environment will vary depending on the thickness of the sheet; the thicker the sheet the longer the required exposure time, the calculation of same being relatively simple for one having skill in the art. Alternatively, the required exposure time for cooling the metal workpiece to the desired temperature can be obtained experimentally. A more efficient utilization of the refrigeration from the liquid cryogen can be achieved by using the cold effluent vaporized gas from the liquid bath to precool the sheet coming from the uncoiler.

When the sheet emerges from the cryogen bath, it is transported with sufficient speed to the slitter or to the blanking or punching press, to insure that the sheet is still at the desired cryogenic temperature when the slitting knives or the blanking or punching dies shear the metal. If desired, the slitting knives or the blanking and punching dies may also be cooled to a cryogenic temperature to provide additional cooling of the work metal.

Round bar sections are preferably sheared in a manner entirely analagous to the process described above for shearing coiled sheet. Thus, the bar stock is first cooled to a cryogenic temperature by immersing it in a cryogenic fluid such as liquid nitrogen, and thereafter the chilled bar stock is positioned between the upper and lower blades of a shear while making certain that the bar is still at the desired cryogenic temperature when the shearing action takes place.

EXAMPLE 1

A 1010 cold-rolled low carbon sheet steel, 0.060 inch thick and 6 inches long, was cooled to 77°K by immersion in a liquid nitrogen bath. The sheet was then removed from the liquid nitrogen bath and quickly positioned between the upper and lower blades of a hand shear. The blades were at room temperature and the shear angle between the blades was 2°. A ⅜ inch wide strip was sheared from the sheet. The strip did not have any noticeable twist or bow.

The experiment described above was repeated except that the workpiece was sheared at room temperature rather than being cooled to 77°K. The resulting metal strip had a 90° twist and ½ inch bow over the 6 inches length.

EXAMPLE 2

A 1010 cold-rolled low carbon sheet steel, 0.60 inch thick was cooled to 77°K by immersion in a liquid nitrogen bath. The sheet was then removed from the liquid nitrogen bath and quickly positioned between the punch and die of a blanking die. The clearance between punch and die was 0.025 mm. Shearing was conducted at a rate of 5 mm/min.

The experiment described above war repeated except that the workpiece was sheared at room temperature rather than being cooled at 77°K. A comparison of sheared edges which were formed in the work metal in both of these experiments yielded the following:

a. In the metal sheared at 77°K, the extent of the rollover was reduced by a factor 3.

b. In the metal sheared at 77°K, the depth of the work-hardened region extending out from the sheared edge was reduced by a factor of 3.

c. In the metal sheared at 77°K, the burr height was decreased significantly.

At larger clearance distances (i.e. above 0.025 mm) between the punch and die, proportionately higher shear rates must be used in order to observe improvements of the order described above.

What is claimed is:

1. A process for shearing a steel workpiece of sheet or round bar stock having a body centered cubic crystallographic structure comprising the steps of:

a. cooling the workpiece to a temperature below minus 70°C; and b. applying a shearing force to the cooled workpiece by positioning two blades on opposite sides of the surface of the workpiece with the cutting edges of the blades opposite to each other and perpendicular to the surface, said cutting edges having sufficient clearance between them so that the cutting edges will not meet, and moving at least one blade toward the other blade at such a rate to meet and shear the workpiece and cause adiabatic heating at the point of shear in the workpiece.

2. The process of claim 1 wherein the cooling step is accomplished with liquid nitrogen.

* * * * *